United States Patent [19]

Iwaya et al.

[11] Patent Number: 4,808,883

[45] Date of Patent: Feb. 28, 1989

[54] DISCHARGE LAMP DEVICE HAVING SEMICONDUCTOR CERAMIC CATHODE

[75] Inventors: Shouichi Iwaya; Hitoshi Masumura; Munemitsu Hamada, all of Tokyo, Japan

[73] Assignee: TDK Corporation, Tokyo, Japan

[21] Appl. No.: 171,228

[22] Filed: Mar. 22, 1988

Related U.S. Application Data

[63] Continuation-in-part of Ser. No. 28,509, Mar. 20, 1987, abandoned.

[30] Foreign Application Priority Data

| | | | |
|---|---|---|---|
| Jun. 11, 1986 | [JP] | Japan | 61-135248 |
| Jul. 15, 1986 | [JP] | Japan | 61-108590[U] |
| Jul. 15, 1986 | [JP] | Japan | 61-108591[U] |
| Jul. 15, 1986 | [JP] | Japan | 61-108592[U] |
| Jul. 15, 1986 | [JP] | Japan | 61-108593[U] |

[51] Int. Cl.[4] ..... H01J 61/06

[52] U.S. Cl. ..... 313/632; 313/633; 313/336

[58] Field of Search ..... 313/336, 350, 355, 357, 313/574, 623, 625, 631, 632, 633

[56] References Cited

U.S. PATENT DOCUMENTS

| | | | |
|---|---|---|---|
| 3,248,586 | 4/1966 | Schlegel | 313/632 X |
| 3,312,853 | 4/1967 | Mela | 313/632 |
| 4,092,560 | 5/1978 | Puskas | 313/631 X |
| 4,559,472 | 12/1985 | Triebel et al. | 313/631 X |
| 4,672,286 | 6/1987 | Duenisch et al. | 313/632 X |

OTHER PUBLICATIONS

Sinter Electrode Type used for Mercury-Vapor Lamp; published on Aug. 28, 1974, by Denki Gakkai Corporation.

J. Illum. Engng. Inst. Japan vol. 69 No. 1; published 1985 pp. 24 to 27 by Shoumei Gakkai.

*Primary Examiner*—David K. Moore
*Assistant Examiner*—K. Wieder
*Attorney, Agent, or Firm*—Armstrong, Nikaido, Marmelstein & Kubovcik

[57] ABSTRACT

A discharge lamp device includes a tube, and a cathode disposed in said tube and made of a valence-compensated semiconductor ceramic material, or a forcibly reduced semiconductor ceramic material, or a valence-compensated and forcibly reduced semiconductor ceramic material. Since the cathode does not include an electron-emitting material, but uses a semiconductor ceramic material, no vapor is produced by the cathode and also the cathode does not react with mercury vapor filled in the tube. Therefore, the discharge lamp device has improved characteristics such as greater heat resistance, better chemical resistance, and improved discharge characteristics. The discharge lamp device is less costly because the semiconductor ceramic material used as the cathode is inexpensive.

15 Claims, 7 Drawing Sheets

TEST CONDITIONS

| W | BALLAST | TUBU | TEST METHOD | LONGEVITY | STARTER | NUMBER |
|---|---|---|---|---|---|---|
| 15W | S51-GI-15 | INVENTIVE | 10-SEC. ON/OFF | BREAKAGE | GLOW DIS.TUBE | 10 |
| | | CONVENTIONAL (FL15W) | | | | 10 |

DISCHARGE LAMP DEVICE HAVING SEMICONDUCTOR CERAMIC CATHODE

This application is a continuation-in-part of application Ser. No. 028,509, filed Mar. 20, 1987, now abandoned.

BACKGROUND OF THE INVENTION

The present invention relates to a discharge lamp device having a cathode made of a semiconductor ceramic material.

There are known discharge lamp devices employing cold cathodes such as a sodium vapor lamp. The cathode or discharge electrode of such a discharge lamp comprises a coiled tungsten filament to be heated that is coated on its surface with an electron-emitting material, which is an oxide mainly composed of barium, strontium, and calcium.

The conventional cathode has however been disadvantageous in that the electron-emitting material tends to evaporate and react with mercury vapor filled in the lamp tube, failing to meet various desired requirements as to heat resistance, chemical resistance, and discharge characteristics of discharge lamp devices. Another problem is that since tungsten is expensive, the cost of the discharge lamp devices is high.

SUMMARY OF THE INVENTION

In view of the aforesaid drawbacks of the conventional discharge lamp devices, it is an object of the present invention to provide a discharge lamp device which can sufficiently meet various desired requirements as to heat resistance, chemical resistance, and discharge characteristics.

Another object of the present invention is to provide a discharge lamp device which can be manufactured inexpensively.

According to the present invention, there is provided a discharge lamp device including a tube, and a cathode disposed in said tube and made of a valence-compensated semiconductor ceramic material, or a forcibly reduced semiconductor ceramic material, or a valence-compensated and forcibly reduced semiconductor ceramic material. Since the cathode does not include an electron-emitting material, but uses a semiconductor ceramic material, no vapor is produced by the cathode or the cathode does not react with mercury vapor filled in the tube. Therefore, the discharge lamp device has improved characteristics such as heat resistance, chemical resistance, and discharge characteristics. The discharge lamp device is less costly because the semiconductor ceramic material used as the cathode is inexpensive.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
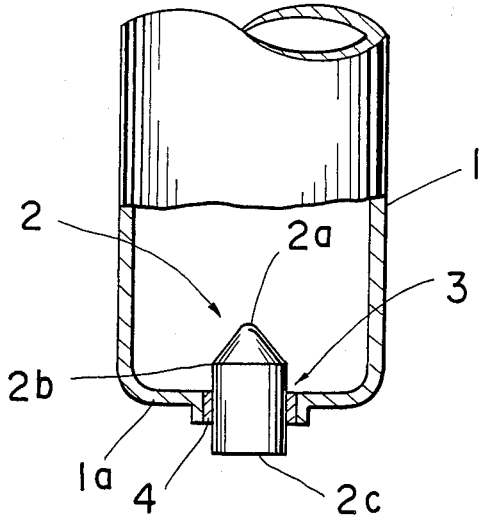
FIG. 1 is a fragmentary cross-sectional view of a discharge lamp device according to an embodiment of the present invention.

FIG. 1 shows a discharge lamp device according to an embodiment of the present invention. The discharge lamp device includes a tube 1 of glass having an end 1*a* through which a cathode 2 extends. The cathode 2 comprises a conical discharge surface 2*a* positioned in the tube 1, a cylindrical base portion 2*b* supported on the tube end 1*a*, and an outer end 2*c* projecting out of the tube end 1*a*. The cathode 2 is sealed in a sealing region 3 by a sealing layer 4 of glass disposed between the base portion 2*b* and the tube end 1*a*. The tube 1 is filled with mercury vapor. The cathode 2 is constructed of a semiconductor ceramic material.

The semiconductor ceramic material may be a valence-compensated ceramic material, for example. One typical valence-compensated ceramic material is barium titanate.

As is well known, valence compensation is achieved by adding as an impurity a metal ion with its valence different by ±1 from a constituent metal ion of a metal oxide and compensating for an increase or reduction in the electric charge, caused by the addition of the impurity, with the valence number of the constituent metal ion.

Examples of valence-compensating additives for making materials semiconductive are Y, Dy, Hf, Ce, Pr, Nd, Sm, Gd, Ho, Er, Tb, Sb, Nb, W, Yb, Sc, Ta, or the like. These additives may be used singly or in combination. The additive or additives should be added in an amount ranging from 0.01 to 0.8 mol %, and preferably from 0.1 to 0.5 mol %.

The material of the cathode 2 is preferably one or a composite of titanates such as barium titanate, strontium titanate, calcium titanate, and lanthanum titanate. The titanic acid in the above titanates may be replaced with one or more of zircon acid, silicic acid, and stannic acid.

The semiconductor ceramic material of the invention may be a forcibly reduced semiconductor ceramic material. More specifically, rather than employing the reduction process as described above, the semiconductor ceramic material for use as the cathode may be produced, without using an additive as referred to above, under sufficient reducing conditions. In such a case, the reduction process is carried out in a reducing atmosphere of $N_2$ or $H_2$ and preferably at a temperature of 700° C. or higher, or more preferably in the range of 1200° to 1450° C.

The cathode may also be formed by combining the valence compensation process and the forced reduction process in the following manner:

(a) An additive for making a cathode material semiconductive is added to produce a formed body of a valence-compensated semiconductor ceramic material; and (b) The formed body is directly calcined for reduction, or ceramic material that has been sintered by being calcined in air is further calcined for reduction.

Experiments conducted on semiconductor ceramic materials will be described below.

The tip end of a valence-compensated semiconductor ceramic material was ground into a conical shape of 60°. The specific resistance of the semiconductor ceramic material thus obtained was 9.9Ω cm.

The semiconductor ceramic material was further calcined in a reducing atmosphere of $H_2+N_2$ with $H_2$ at a density of 20% at 1250° C. for 2 hours in a stable state. The specific resistance of the calcined material was 0.90Ωcm.

Substantially the same results were obtained from other titanates. Table 1, given below, shows specific resistances of various semiconductor ceramic materials for use as discharge lamp cathodes.

TABLE 1

| No. | Composition | Before reduction Ωcm | After reduction Ωcm |
|---|---|---|---|
| (1) | $BaTiO_2$—$Y_2O_3$ 0.15 mol % - $SiO_2$ 0.6 wt % | 9.9 | 0.90 |
| (2) | $SrTiO_3$—$Dy_2O_3$ 0.3 mol % - $SiO_2$ 0.6 mol % | 0.50 | 0.048 |
| (3) | $SrTiO_3$ 62 wt % - $La_2O_3$ $3TiO_2$ 10 wt % - $CaTiO_3$ 27.7 wt % - $Nb_2O_5$ 0.3 wt % | 0.35 | 0.032 |

Substantially the same results were obtained from those materials in which the titanic acid of the titanates was replaced with one or more of silicic acid and tin acid.

Figure 3:
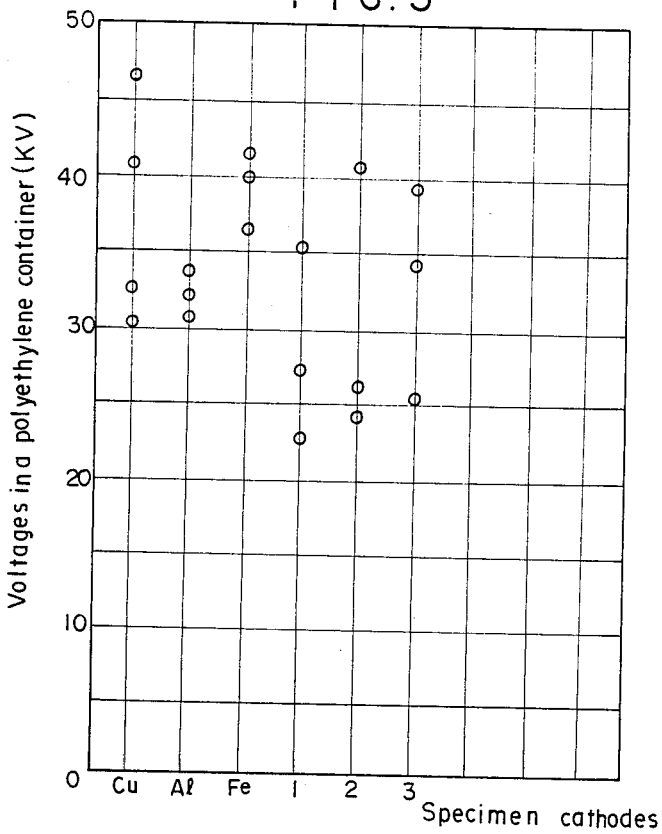
FIG. 3 is a graph showing experimental data of the cathode.

To check the electron emission capability, the cathode materials (1) through (3) given above in Table 1 were measured for field intensities. Other materials such as Al having relatively low work functions were also measured for comparison. The results of the measurement are shown in FIG. 3. The graph of FIG. 3 has a vertical axis representative of discharge voltages [KV] in a polyethylene container and a horizontal axis indicative of specimen cathodes which include comparison cathodes of Cu, Al, Fe, and the inventive cathodes (1) through (3).

Figure 2:
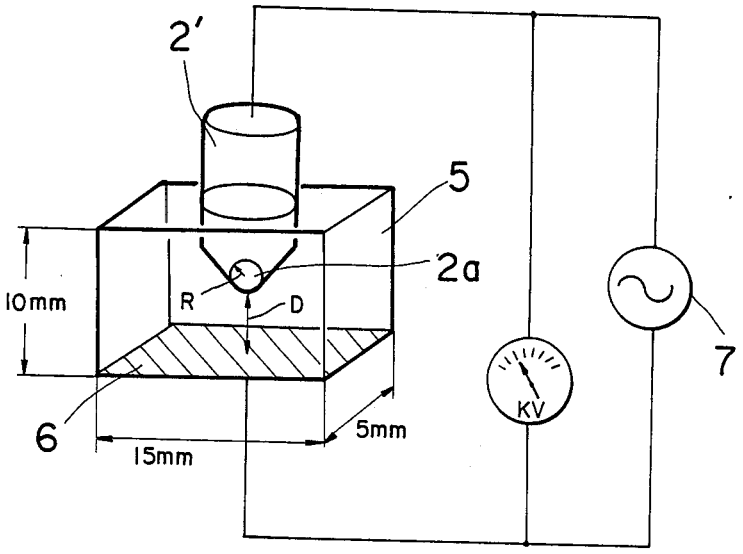
FIG. 2 is a schematic view of a system for experimentally determining discharge voltage of a cathode in the discharge lamp device of the invention.

The experiments were carried out by a system shown in FIG. 2. A polyethylene container 5 had a width of 15 mm, a depth of 5 mm, and a height of 10 mm, and the bottom thereof was coated with a mercury paste layer 6. A specimen cathode 2' was placed over the container bottom, and an AC power supply 7 was connected between the specimen cathode 2' and the mercury paste layer 6. The spherical tip end of the specimen cathode 2' had a radius R of 20 micrometers, and was spaced from the mercury paste layer 6 by a distance D of 4 mm. The voltage applied by the AC power supply 7 between the specimen cathode, 2' and the mercury paste layer 6, as measured by kilvolt meter 8, was 10 KV at first, and incremented by 1 KV at intervals of 1 minute.

As is apparent from the results given in FIG. 3, the inventive cathodes can produce discharges at lower voltages than the comparative cathodes. It can be understood that the semiconductor ceramic materials of the present invention have discharge characteristics which are as well or better than those of metallic materials. The cathode 2 (FIG. 1) which is made of the semiconductor ceramic material of the invention has stable discharge characteristics and can be manufactured inexpensively.

Figure 4:
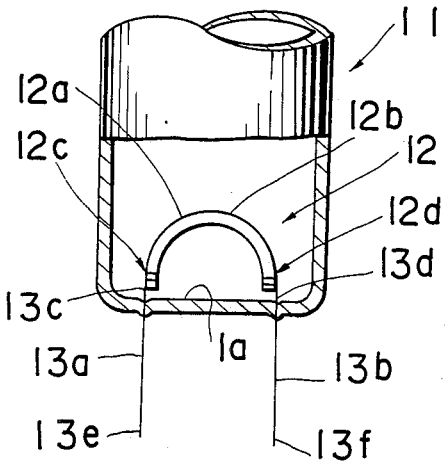
FIG. 4 is a fragmentary cross-sectional view of a discharge lamp device according to another embodiment of the present invention.

FIG. 4 shows a discharge lamp device according to another embodiment of the present invention. The discharge lamp device includes a tube 11, a cathode 12 made of a semiconductor ceramic material and disposed in the tube 11, and a pair of lead wires **13*a*, 13*b* supporting the cathode 12 in the tube 11 in the vicinity of a tube end 11*a***.

Figure 5:
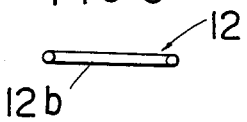
FIG. 5 is a bottom view of a cathode in the discharge lamp device shown in FIG. 4.

As shown in FIG. 5, the cathode 12 has a circular cross section. The cathode 12 is of a semicircular shape including a base portion **12*b* having a semicircular discharge surface 12*a*. The opposite ends of the base portion 12*b* serve as connectors 12*c*, 12*d* joined to the lead wires 13*a*, 13*b*. The lead wires 13*a*, 13*b* extend through the tube end 11*a* and are spaced from each other. The lead wire portions extending through the tube end 11*a* are sealed by the tube end 11*a*. The lead wires 13*a*, 13*b* have end portions 13*c*, 13*d* projecting into the tube 11 and wound in several turns around the connectors 12*c*, 12*d* of the cathode 12 to support the plane of the cathode 12 such that the cathode 12 lies substantially perpendicularly to the tube end 11*a*. The lead wires 13*a*, 13*b* also have rear end portions 13*e*, 13*f* projecting out of the tube 11. A power supply is connected between the rear end portions 13***e*, 13*f* for passing an electric current through the cathode 12.

Figure 6:
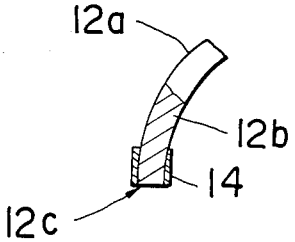
FIG. 6 is an enlarged fragmentary cross-sectional view of a cathode which is a modification of the cathode of FIG. 5.

As shown in FIG. 6 on an enlarged scale, an electrically conductive film 14 may be applied by vapor deposition or sputtering on the outer periphery of the connector 12*c*. Although not shown, the other connector 12*d* of the cathode 12 is also coated with the same electrically conductive film. The elctrically conductive film reduces the contact resistance between the lead wires 13*a*, 13*b* and the cathode 12.

Figure 7:
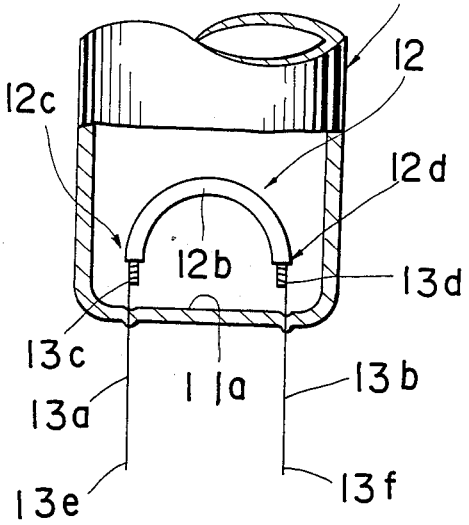
FIG. 7 is a fragmentary cross-sectional view of a discharge lamp device according to still another embodiment of the present invention.
Figure 8:
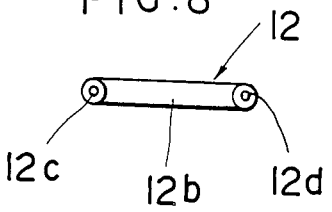
FIG. 8 is a bottom view of a cathode in the discharge lamp device shown in FIG. 7.
Figure 9:
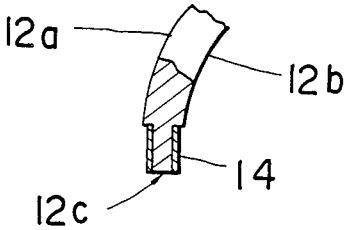
FIG. 9 is an enlarged fragmentary cross-sectional view of a cathode according to a modification of the cathode of FIG. 8.

FIGS. 7 and 8 show still another embodiment of the present invention. Those parts in FIG. 7 which are functionally identical to those shown in FIG. 4 are denoted by identical reference characters. The cathode 12 of FIG. 7 differs from the cathode of FIG. 4 in that the opposite ends of the base portion 12*b* have connectors 12*c*, 12*c* of a smaller diameter than that of the base portion 12*b*, and the end portions 13*c*, 13*d* of the lead wires 13*a*, 13*b* are wound in several turns around the connectors 12*c*, 12*d* to support the cathode 12. The discharge lamp device of FIG. 7 functions in the same manner as that of the discharge lamp device of FIG. 4. Since the lead wires 13*a*, 13*b* are wound around the smaller-diameter connectors 12*c*, 12*d*, the process of winding the lead wires 13*a*, 13*b* is easy to perform. As illustrated in FIG. 9, an electrically conductive film 14 may be coated on the outer periphery of the connector 12*c*. The other connector 12*d* may also be coated with an electrically conductive film.

Figure 10:
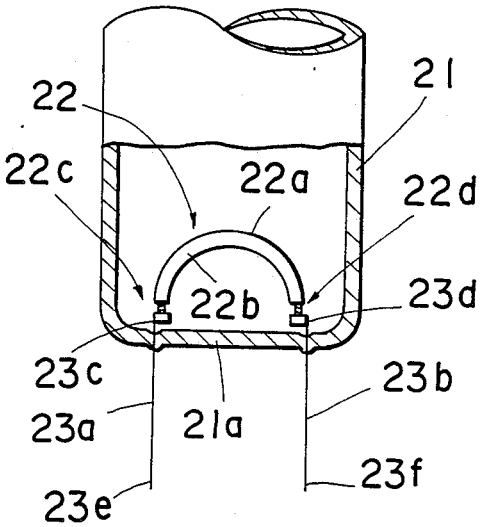
FIG. 10 is a fragmentary cross-sectional view of a discharge lamp device according to yet still another embodiment of the present invention.
Figure 11:
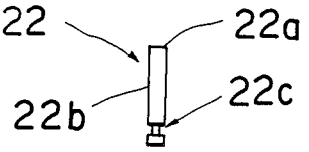
FIG. 11 is a side elevational view of a cathode in the discharge lamp device shown in FIG. 10.

FIGS. 10 and 11 illustrate a discharge lamp device according to a further embodiment of the present invention. The discharge lamp device includes a tube 21, a cathode 22 made of a semiconductor ceramic material and disposed in the tube 21, and a pair of lead wires 23*a*, 23*b* supporting the cathode 22 in the tube 11 in the vicinity of a tube end 21*a*.

As shown in FIG. 11, the cathode 22 has a circular cross section. The cathode 22 is of a semicircular shape including a base portion 22*b* having a semicircular discharge surface 22*a*. The opposite ends of the base portion 22*b* serve as connectors 22*c*, 22*d* joined to the lead wires 23*a*, 23*b*. The connectors 22*c*, 22*d* are formed as recessed portions of a smaller diameter than that of the base portion 22*b* by cutting off the peripheral surfaces of the base portion 22*b* which are positioned slightly inwardly of the opposite ends thereof.

The lead wires 23*a*, 23*b* extend through the tube end 21*a* and are spaced from each other. The lead wire portions extending through the tube end 21*a* are sealed by the tube end 21*a*. The lead wires 23*a*, 23*b* have end portions 23*c*, 23*d* projecting into the tube 21 and wound in several turns around the connectors 22*c*, 22*d* of the cathode 22 to support the plane of the cathode 22 such that the cathode 22 lies substantially perpendicularly to the tube end 21*a*. The lead wires 23*a*, 23*b* also have rear end portions 23*e*, 23*f* projecting out of the tube 21. A power supply is connected between the rear end portions 23*e*, 23*f* for passing an electric current through the cathode 22.

Figure 12:
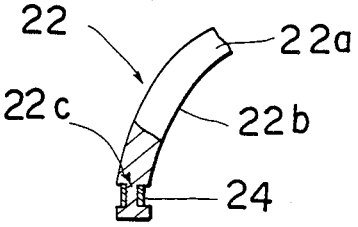
FIG. 12 is an enlarged fragmentary cross-sectional view of a cathode that is a modification of the cathode of FIG. 11.

As shown in FIG. 12, an electrically conductive film 24 may be applied by vapor deposition or sputtering on the outer periphery of the connector 22*c*. Although not shown, the other connector 22*d* of the cathode 22 is also coated with the same electrically conductive film. The elctrically conductive film reduces the contact resistance between the lead wires 23*a*, 23*b* and the cathode 22.

Figure 13:
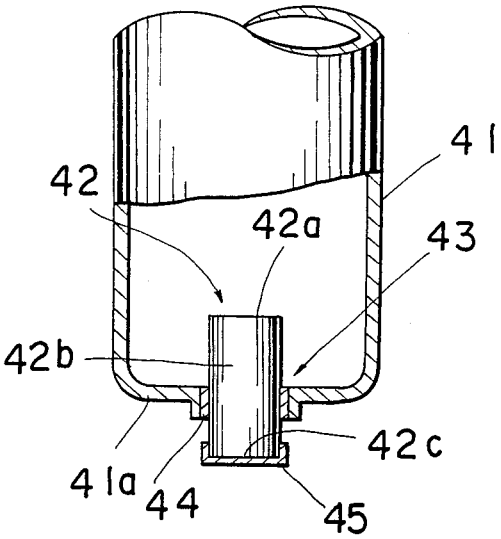
FIG. 13 is a fragmentary cross-sectional view of a discharge lamp device according to a further embodiment of the present invention.
Figure 14:
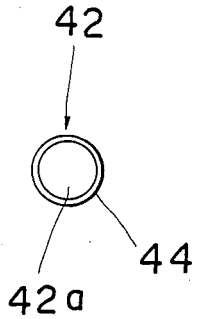
FIG. 14 is a plan view of a cathode in the discharge lamp device illustrated in FIG. 13.

According to a still further embodiment shown in FIGS. 13 and 14, a discharge lamp device comprises a tube 41 made of glass, for example, a cathode 42 made of a semiconductor ceramic material and disposed in the tube 41, and a sealing portion 43 which sealingly secures an outer periphery of the cathode 42, or an intermediate barrel portion thereof, for example, to an end 41*a* of the tube 41.

The cathode 42 includes a cylindrical base portion 42*b* having on one end thereof a circular discharge surface 42*a*, the base portion 42*b* extending through the tube end 41*a*. A sealing layer 44 made of glass or similar material is formed by coating or baking on the outer periphery of the area of the base portion 42*a* which extends through the tube end 41*a*. The sealing portion 43 is formed by sealingly applying the sealing layer 44 to the portion of the cathode 42 which extends through the tube end 41*a*. The tube 41 and the sealing layer 44 are made of glass to faciliate the sealing process and increase airtightness of the sealing portion 43. The discharge surface 42*a* lies parallel to the tube end 41*a*. The cathode 42 has an outer projecting end 42*c* on which there is disposed an electrode 45 as of silver for external connection. An electric current can be passed through the cathode 42 by connecting the electrode 45 to a power supply (not shown).

Figure 15:
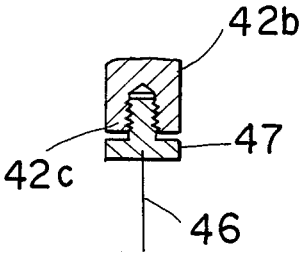
FIGS. 15 and 16 are fragmentary cross-sectional views of cathode ends according to modifications of the cathode shown in FIG. 13.
Figure 16:
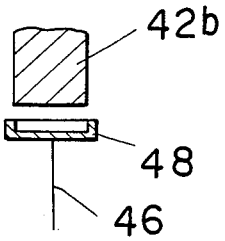

As illustrated in FIG. 15, a screw 47 joined to a lead wire 46 may be threaded into the outer projecting end 42*c*, instead of employing the electrode 45 of FIG. 13, and an electric current may be passed via the screw 47 to the cathode. Alternatively, as shown in FIG. 16, a cap 48 joined to a lead wire 46 may be mounted on the outer projecting end of the cathode for passing an electric current to the cathode.

Figure 17:
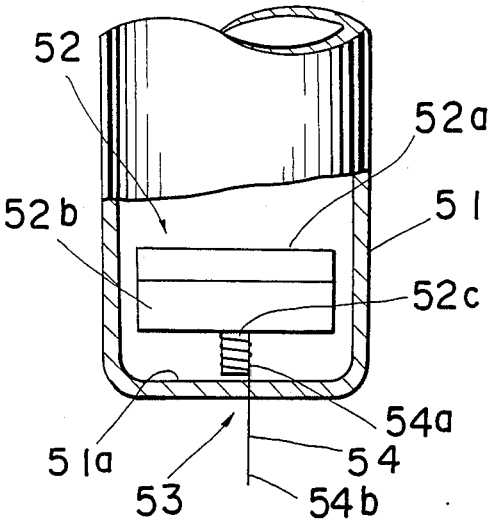
FIG. 17 is a fragmentary cross-sectional view of a discharge lamp device according to a still further embodiment of the present invention.
Figure 18:
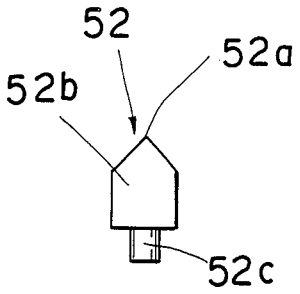
FIG. 18 is a side elevational view of a cathode in the discharge lamp device shown in FIG. 17.

FIGS. 17 and 18 show a discharge lamp device according to a yet still further embodiment of the present invention. The discharge lamp device comprises a tube 51, a cathode 52 made of a semiconductor ceramic material and disposed in the tube 51, and a sealing support portion 53 which sealingly supports the cathode 52 in the tube 51 in the vicinity of an end 51*a* of the tube 51.

As shown in FIG. 18, the cathode 52 is composed of a base portion 52*b* substantially in the form of a rectangular parallelepiped with upper opposite edges mitered to leave a linear discharge surface 52*a*, and a cylindrical projection 52*c* projecting downwardly from a lower central surface of the base portion 52*b*.

The sealing support portion 53 has a lead wire 54 extending through the tube end 51*a* and sealingly supported on the tube end 51*a*. The lead wire 54 has an inner end portion 54*a* disposed in the tube 51 and wound around the projection 52*c* to support the cathode 52 in the tube 51 with the discharge edge 52*a* lying parallel to the tube end 51*a*. The opposite end 54*b* of the lead wire 54 extends out of the tube end 51*a*.

Figure 19:
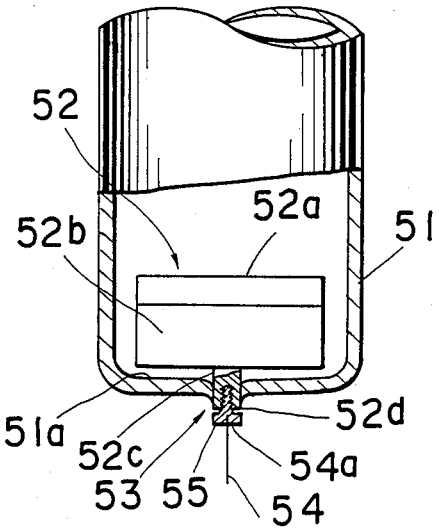
FIGS. 19 and 20 are fragmentary cross-sectional views of discharge lamp devices employing cathode ends according to modifications of the cathode shown in FIG. 17.

FIG. 19 shows a modification of the cathode of FIG. 17. Those components in FIG. 19 which are functionally identical to those of FIG. 17 are designated by identical reference characters. In FIG. 19, the projection 52*c* extends centrally through the tube end 51*a* and has its outer end 52*d* projecting from the tube end 51*a*. A screw 55 in which an upper end 54*a* of the lead wire 54 is embedded is threaded into the projecting end 52*d*, thus forming a sealing support portion 53. The lead wire 54 is connected to a power supply (not shown) for passing an electric current through the cathode.

Figure 20:
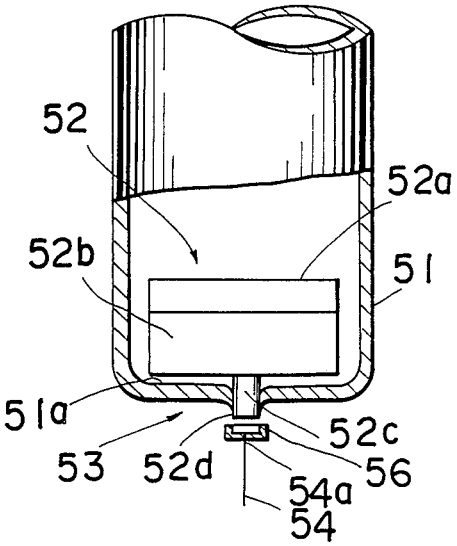

As illustrated in FIG. 20, the lead wire 54 and the cathode 52 may be interconnected by fitting a cap 56 with the upper end 54*a* of the lead wire 54 fixed thereto over the projecting end 52*d* of the projection 52*c*.

Figure 21:
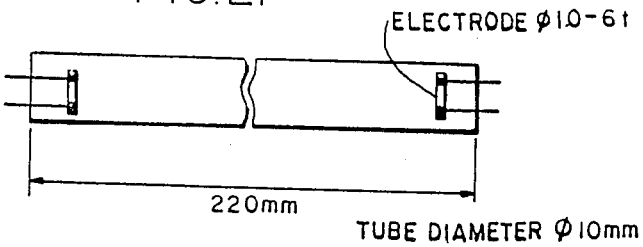
FIG. 21 shows a fluorescent lamp made in accordance with the present invention for testing.
Figure 22:
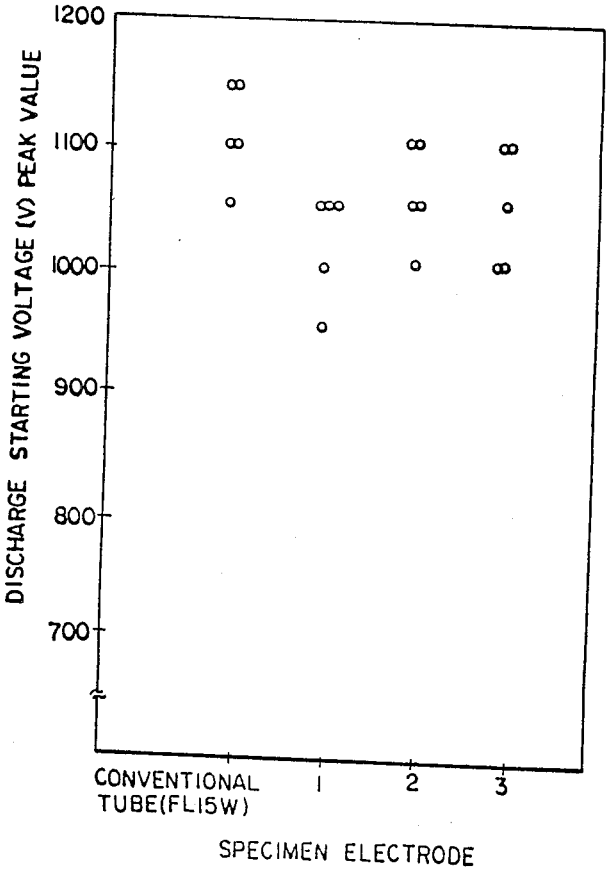
FIG. 22 shows a comparison of discharge starting voltages of conventional fluorescent lamp with starting voltages of lamps made in accordance with the invention.

In order to check the characteristics of the present invention as a practical fluorescent lamp tube, fluorescent lamp tubes having an electrode of a semiconductor ceramic material as shown in FIG. 21 where fabricated, and discharge starting voltages of those fluorescent lamp tubes and a conventional fluorescent lamp tube (FL 15W) of an identical configuration were compared. The results of the comparison are shown in FIG. 22. The discharge starting voltage referred to above is a voltage at which a discharge occurs when an applied AC voltage is gradually increased with a cold cathode while no preheating current is passed. As is apparent from FIG. 22 the specimens of the present invention have lower discharge starting voltages than that of the conventional specimen. In actual use, however, the invention and conventional fluorescent lamp tubes have lower discharge starting voltages because of a preheating current passed. In the experiment, no preheating current was passed so as to clearly indicate the different discharge starting voltages of the inventive and conventional specimens.

Figures 23, 24:
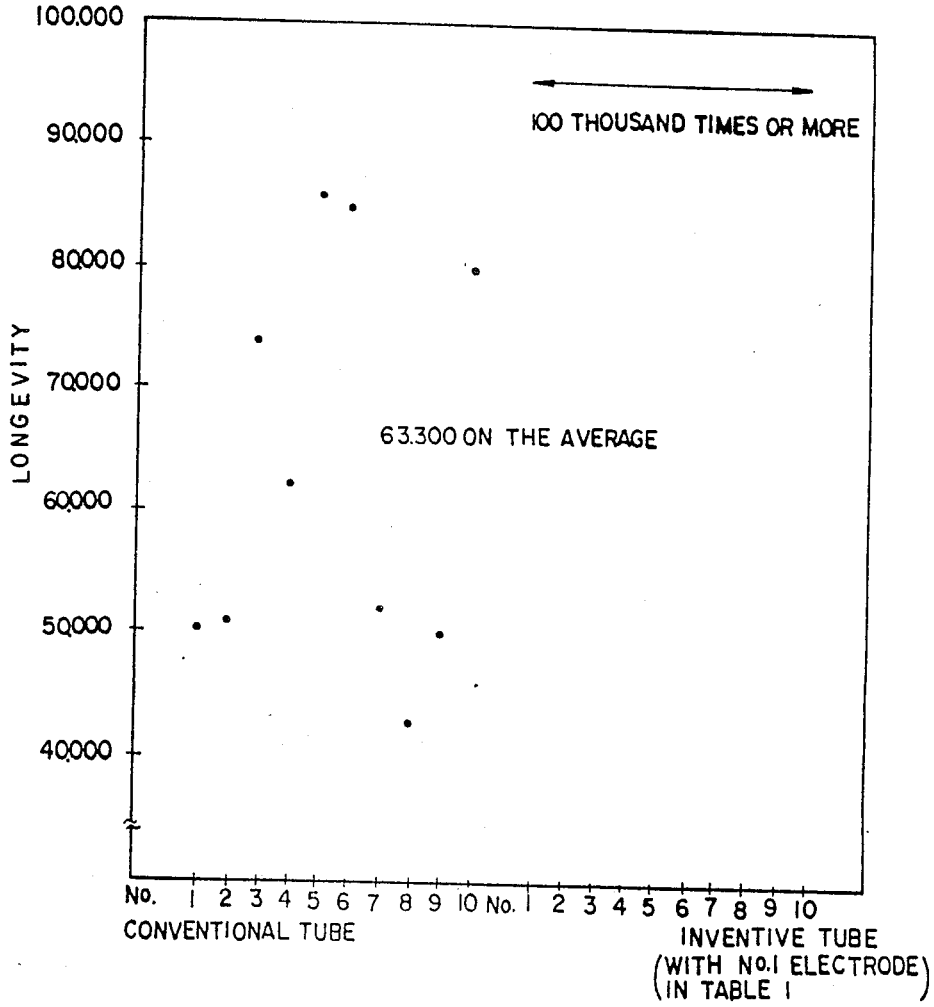
FIG. 23 shows parameters of a longevity test.
FIG. 24 shows results of the longevity test.

Fluorescent lamp tubes using an inventive specimen and conventional fluorescent lamp tubes were also tested for longevity under the configurations sown in FIG. 23. The results of the longevity test are illustrated in FIG. 24. In the test the inventive fluorescent lamp tubes had no breakage failure after they had been energized 100 thousand times, but the conventional fluorescent lamp tubes had a breakage problem after they had been energized 63 thousand times on the average. The test indicates that the inventive fluorescent lamp tubes were more durable than the conventional fluorescent lamp tubes. Since the longevity test which was conducted is different from the JIS longevity test (2.5-minute turn-on time and 0.5-minute turn-off time), the results are not comparable with the results of a known longevity test. However, it can be assumed that substantially the same results as those of the present longevity test would be obtained by a longevity test according to JIS.

It can be found from the results of the tests that a semiconductor ceramic material, used as a discharge electrode, according to the present invention has discharge characteristics and durability which are the same as or better than those of a discharge electrode in the form of a conventional tungsten filament coated with an electronemitting material.

Although certain preferred embodiments have been shown and described, it should be understood that many changes and modifications may be made therein without departing from the scope of the appended claims.

We claim:

1. A discharge lamp device comprising a tube, and a cathode disposed in said tube, said cathode being composed of a material selected from the group consisting of a valence-compensated semiconductor ceramic material, a forcibly reduced semiconductor ceramic material, and a valence-compensated and forcibly reduced semiconductor ceramic material.

2. A discharge lamp device according to claim 1, wherein said semiconductor ceramic material includes a principal component selected from the group consisting of oxides of titanium, barium, strontium, calcium, lanthanum, zirconium, and tin.

3. A discharge lamp device according to claim 1, wherein said valence-compensated semiconductor ceramic material includes a valence-compensating additive selected from the group consisting of Y, Dy, Hf, Ce, Pr, Nd, Sm, Gd, Ho, Er, Tb, Sb, Nb, W, Yb, Sc, and Ta.

4. A discharge lamp device according to claim 1, wherein said cathode has an arcuate discharge surface, further including lead wires extending through an end of said tube and supporting said cathode.

5. A discharge lamp device according to claim 1, wherein said cathode includes a base portion having a semicircular discharge surface and connectors on opposite ends thereof, further including lead wires extending through an end of said tube and supporting said connectors, respectively.

6. A discharge lamp device according to claim 5, wherein each of said connectors is coated on its surface with an electrically conductive film.

7. A discharge lamp device according to claim 1, wherein said cathode has a linear discharge surface, said tube having a sealing support portion by which said cathode is supported.

8. A discharge lamp device according to claim 7, wherein said sealing support portion comprises lead wires extending through and sealingly secured to an end of said tube, said lead wires having end portions wound around a projection disposed on said cathode remotely from said discharge surface.

9. A discharge lamp device according to claim 7, wherein said sealing support portion comprises a projection disposed on said cathode remotely from said discharge surface and sealingly secured to an end of said tube.

10. A discharge lamp device according to claim 7, wherein said sealing support portion comprises a projection disposed on said cathode and having an end projecting out of said tube, and a lead wire connected to said projecting end of said projection.

11. A discharge lamp device according to claim 1, wherein said cathode has an arcuate discharge surface and recesses defined respectively in opposite ends thereof further including lead wires engaging in said recesses and supporting said cathode in said tube.

12. A discharge lamp device according to claim 11, wherein said cathode is coated with an electrically conductive film in each of said recesses.

13. A discharge lamp device according to claim 1, wherein said cathode comprises a cylindrical member having a discharge surface on one end thereof, said cylindrical member having an opposite end extending through and sealingly secured to an end of said tube.

14. A discharge lamp device according to claim 13, wherein said tube is made of glass, further including a layer of glass disposed around said cylindrical member and sealingly attached to said tube.

15. A discharge lamp device according to claim 1, wherein said cathode has an electrode disposed outside of said tube for external connection.

* * * * *